United States Patent [19]

Baskett

[11] 3,930,315

[45] Jan. 6, 1976

[54] APPARATUS FOR SIZING A DOOR TO FIT A SELECTED DOORWAY

[76] Inventor: John L. Baskett, 720 Cottonwood, Fort Collins, Colo. 80521

[22] Filed: July 8, 1974

[21] Appl. No.: 486,443

[52] U.S. Cl. ..... 33/194; 33/42; 33/175

[51] Int. Cl.[2] ..... E04F 21/00; B43L 13/02

[58] Field of Search ..... 33/194, 42, 175

[56] References Cited

UNITED STATES PATENTS

| | | | |
|---|---|---|---|
| 1,595,164 | 8/1926 | Mundy et al | 33/194 |
| 1,664,076 | 3/1928 | Humphrey | 33/194 |
| 2,567,771 | 9/1951 | Hurd | 33/194 |
| 3,121,958 | 2/1964 | Findley | 33/194 |
| 3,126,644 | 3/1964 | Dale | 33/194 |

*Primary Examiner*—Richard E. Aegerter
*Assistant Examiner*—Charles E. Phillips
*Attorney, Agent, or Firm*—Burton, Crandell & Polumbus

[57] ABSTRACT

The method of the invention includes the steps of positioning a support member having a substantially vertically extending recording surface thereon in the doorway for which the door is being sized, recording the contour of each side door jamb of the doorway on the recording surface by transposing the contour with a tracer mechanism having a follower adapted to be advanced along each side door jamb and a marker for recording on the surface information corresponding to the contour of the side door jamb, placing the recorded information in a cutting apparatus having means for controlling a cutter device in correspondence with the recorded information so that the cutter device is advanced along each side of the door member to cut the sides of the door to match the contours of the associated side door jambs. The apparatus of the invention consists of a vertically extending support member having a sheet of material extended vertically therealong, a centering assembly for positioning the support along the central vertical axis of the door opening, and a tracer mechanism movable along the support member and having followers adapted to engage the side door jambs whereby markers on the tracer mechanism will mark lines on the sheet of material as the tracer mechanism is advanced along the support member with the lines corresponding in contour to that of the associated side door jamb. The support member also includes adjustable means for comparing the head door jamb with horizontal.

11 Claims, 8 Drawing Figures

APPARATUS FOR SIZING A DOOR TO FIT A SELECTED DOORWAY

BACKGROUND OF INVENTION

The present invention relates generally to fitting doors to selected door openings, and more particularly to a method and apparatus for quickly and easily sizing a selected door opening and cutting a door member to fit the opening.

DESCRIPTION OF THE PRIOR ART

Doors have typically been fitted to selected doorways or door openings by making hand measurements of the doorway and attempting to transpose the measurements onto the door so that it can be cut in accordance with the measurements. Often, however, the door must be mounted and taken down a number of times before it is suitably sized and cut for the doorway.

In an attempt to avoid this time consuming and not so accurate method of sizing and cutting a door to fit a selected doorway, various devices have been developed. One such device consists of an apparatus that can be placed in the doorway with positioning members adapted to be moved into engagement with selected locations around the doorway so that the appratus can subsequently be removed from the doorway, placed upon a door member, and lines drawn connecting the selected locations thereby transposing the desired configuration and size of the doorway onto the door member so that it can be cut to fit the doorway.

OBJECTS OF THE INVENTION

It is an object of the present invention to provide a new and improved method of sizing and cutting a door to fit a selected door opening wherein information relating to the size and configuration of the door opening is recorded and used to operate an automatic cutting apparatus which cuts a door member in accordance with the prerecorded information.

It is another object of the present invention to provide an apparatus for recording information relating to the size and configuration of a door opening which includes means for centering a support member along the central vertical axis of the door opening, the support member having a vertically extending markable surface thereon, and tracing means for movement along the support member to record in legible form on the markable surface information corresponding to the contour of the side door jambs of the door opening.

SUMMARY OF THE INVENTION

The method of the present invention basically includes the steps of measuring and recording information relating to the size and configuration of a selected door opening and then utilizing this information to guide cutter devices in cutting a door member to fit the door opening. More particularly, in accordance with the method of the present invention, lines corresponding with the vertical contour of the side door jambs of a selected door opening are traced onto a markable surface and measurements are made to compare the head door jamb with horizontal. This information is then, in the preferred form of the invention, used to cut the top edge of the door member and operate a cutting mechanism which automatically cuts the side edges of the door member to correspond with the information relating to the vertical contour of the side door jambs.

The apparatus of the present invention is used to measure a selected doorway and has means for recording information relating thereto on information receiving material for use in cutting the door member to the desired size and configuration. The apparatus includes a vertical support member which carries a centering mechanism for facilitating the positioning of the support member along the central vertical axis of the doorway. The support member is properly centered by a pair of positioning arms which are pivotally connected to the support member at their inner ends and which have outer ends adapted to engage the side door jambs. The positioning arms are interconnected by a horizontal level instrument which when horizontally oriented, assures that the support member is centered in the doorway. The horizontal level also establishes a horizontal reference so that the head door jamb of the door opening can be compared to horizontal and the information relating thereto used to cut the upper edge of the door member to correspond with the inclination of the head door jamb.

A tracing mechanism is mounted upon the support member for vertical sliding movement. The tracing mechanism includes a pair of markers which engage, in the preferred form, an elongated sheet of material mounted upon the support member and the markers are connected to a pair of followers which engage the side door jambs of the door opening whereby upon vertical movements of the tracer mechanism along the support member, the contour of each side door jamb is marked on the sheet in a legible manner thereby recording the vertical contour information corresponding to each side door jamb on the sheet. The sheet of material, with the recorded information thereon, may then be used with suitable cutting apparatus for cutting the side edges of a door member to conform to the vertical contours of the side door jambs.

As will be appreciated from the detailed description hereinafter, the invention enables a carpenter or the like to measure and record information relating to a plurality of doorways and then forward the information to a remote location where cutting machinery is situated for cutting the doors to fit the previously measured doorways.

Other objects, advantages and capabilities of the present invention will become more apparent as the description proceeds taken in conjunction with the accompanying drawings.

DESCRIPTION OF THE PREFERRED EMBODIMENT

Figure 1:
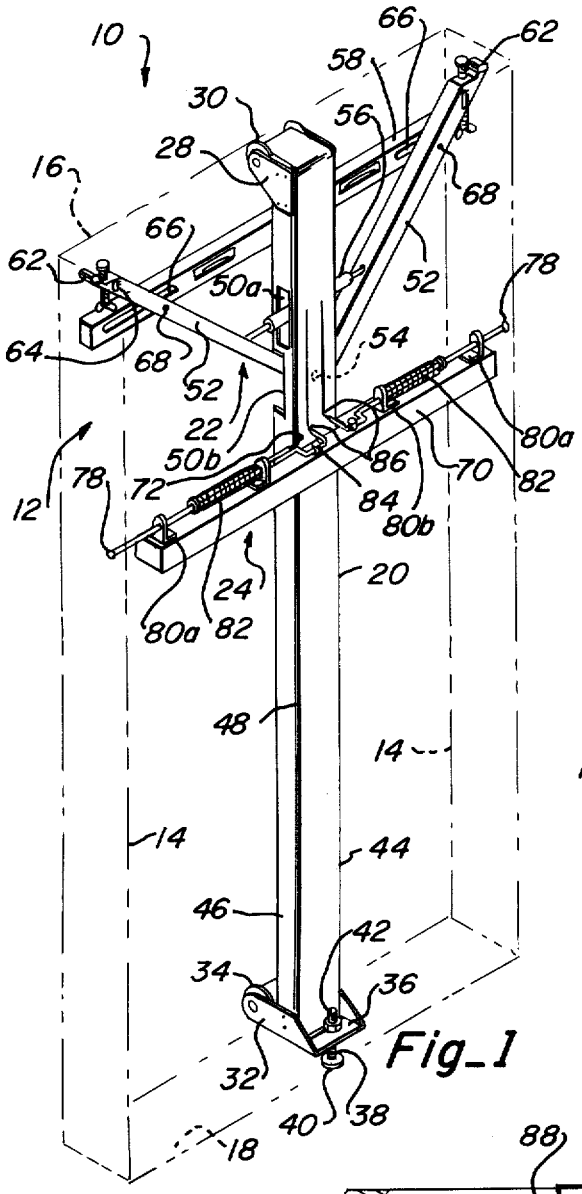
FIG. 1 is a perspective view of the apparatus of the present invention disposed within a door opening shown in phantom lines.
Figure 2:
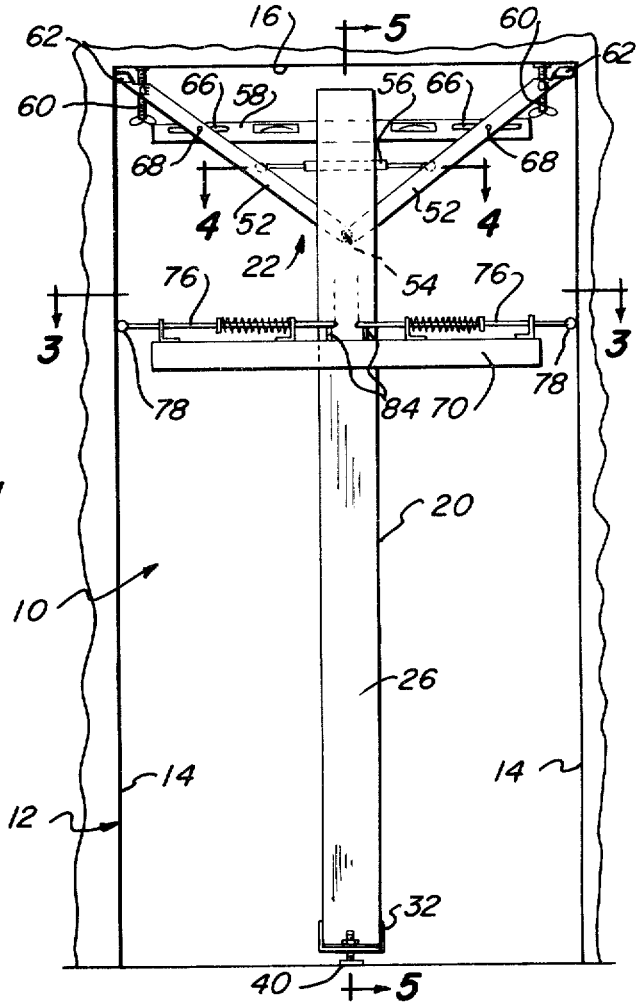
FIG. 2 is a front elevation of the apparatus shown in FIG. 1.

Referring first to FIGS. 1 and 2, the door sizing apparatus 10 of the present invention is shown disposed within a door opening or doorway 12 having left and right side door jambs 14 and a head door jamb 16. Across the foot of the doorway is the conventional threshold 18. The apparatus includes a support member or plumb guide beam 20, a centering mechanism generally indicated at 22, a tracing mechanism 24 and an elongated sheet of markable material 26 extended vertically along the front face of the guide beam and anchored at opposite ends of the guide beam.

The plumb guide beam 20 in the disclosed form is a channeled piece of elongated aluminum with the channel opening rearwardly. The upper end of the guide beam has a pair of rearwardly extending brackets 28 which support an upper spool 30 to which the upper end of the markable material 26 is anchored. The spool 30 is preferrably rotatably connected to the brackets 28 and gripped frictionally so that it can be rotated upon application of a predetermined force but otherwise will retain its angular orientation. The lower end of the guide beam has a bracket 32 which extends both forwardly and rearwardly of the guide beam with the rear extent of the bracket supporting a lower spool 34 to which the lower end of the markable material 26 is connected. Again, the lower spool 34 is rotatably mounted in such a manner that it is frictionally gripped by the bracket 32 but can be rotated upon application of a predetermined force. The forward extent of the lower bracket 32 defines a horizontal flange 36 through which a vertically extending adjustment screw 38 is received. The adjustment screw 38 has an abuttment head 40 on its lower end adapted to engage the threshold 18 of the doorway and to be selectively disengaged therefrom when desired. A lock nut 42 is threaded onto the upper end of the adjustment screw to lock the screw into position when it has been desirably abutted or engaged with the threshold.

The guide beam 20 has a front wall 44 and a pair of rearwardly extending sidewalls 46. Each sidewall 46 along its connection to the front wall is provided with a vertically extending groove 48 for a purpose to be described later.

Near the upper end of the guide beam, upper and lower vertically spaced pairs of notches **50*a* and 50*b* respectively are cut in the sidewalls 46 to facilitate the operation of the centering mechanism 22. The centering mechanism includes a pair of equal length positioning arms 52 which are pivotally connected to the front wall of the guide beam at 54 and protrude laterally away from the guide beam through the lower pair of notches 50*b*, a biasing member 56 interconnecting the positioning arms 52 and extending through the upper pair of notches 50*a*, a horizontal level member 58 also interconnecting the positioning arms, and a pair of adjustment screws 60 passing vertically through the distal ends of the positioning arms. The positioning arms 52 are made, in the disclosed form, from elongated bars of generally rectangular transverse cross-section and have rubber abuttment pads 62 on their distal ends adapted to frictionally engage the side door jambs 14 of the doorway. The adjustment screws 60 which extend through the distal ends of the positioning arms in a generally vertical direction are calibrated at 64 so that their longitudinal position relative to the associated positioning arm is easily determinable. The horizontal level member 58 in the disclosed form is a conventional spirit level having conventional level indicators indicating when the level member is horizontal. At opposite ends of the level member it is provided with horizontal slots 66 which extend along the length of the level member and receive horizontal slide pins 68** which are anchored to each of the positioning arms at a location near the distal ends of the positioning arms.

The tracing mechanism 24 consists of a horizontal tracing beam 70 which in the disclosed form is of solid rectangular transverse cross section having a vertical notch 72 cut in the rear face thereof at the longitudinal center adapted to receive the front portion of the guide beam 20. At opposite sides of the notch 72, ball bearings 74 are received in appropriate sockets and are biased inwardly toward each other by compression springs (not shown). The ball bearings 74 are adapted to be snapped into the grooves 48 running along opposite sides of the guide beam and serve to retain the horizontal tracing beam 70 on the guide beam as it is slid vertically along the length of the guide beam. The horizontal tracing beam can, of course, be removed from the guide beam merely by snapping the ball bearings out of the guide grooves 48. A pair of tracer arms 76 are mounted on the top of the tracing beam 70 and each has a follower 78 at its outer end adapted to engage the adjacent side door jamb 14. The follower 78 could be in the form of a ball or roller bearing or could merely be the blunt end of the arm 76. Each tracer arm is slidably supported axially by a pair of spaced brackets **80*a* and 80*b*, bracket 80*b* serving as an abuttment for one of two coaxial compression springs 82 mounted on the tracer arm. The compression springs 82 serves to bias the arms outwardly into engagement with the side door jambs. The inner end of each arm 76 passes through a generally U-shaped curve with one portion of the U-shaped curve running parallel to the longitudinal axis of the tracer arm. This portion of the U-shaped bend is slidably received in a third bracket 84 which serves to prevent the tracer arm from rotating about the longitudinal axis thereof. A marker head 86 is provided at the inner end of each tracer arm and could be in numerous forms, such as, a ball point pen, an adjustable lead, or the like. The marker heads 86 are adapted to engage the markable material 26 disposed on the front face of the guide beam 20 as to place a legible mark on the markable material as the tracing beam 70 is slid vertically along the guide beam. It will be appreciated that each tracer arm is biased against the associated side door jamb 14 so that the follower 78 engages the side door jamb. Since the tracer arms are of fixed length, and the tracing beam is moved vertically along the guide beam, a generally vertically extending line will be marked upon the markable material 26** to correspond with the vertical contour of each side door jamb. In this manner, information relating to the contour of the side door jambs is placed upon the markable material which can be used later to cut the side edges of a door for the doorway so that the side edges correspond with the contours of the associated side door jambs.

With the horizontal tracing beam 70 at its lowermost position on the guide beam, the distance between each end of the tracing beam and the threshold 18 of the doorway can be measured and manually written upon the markable material so that the lower edge of the door can be made to fit the contour of the threshold of the doorway.

Figure 4:
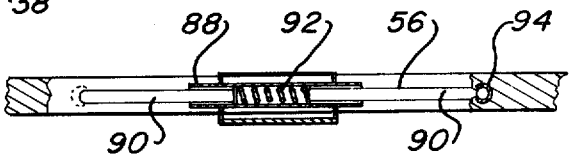
FIG. 4 is an enlarged horizontal section taken along line 44 of FIG. 2.
Figure 3:
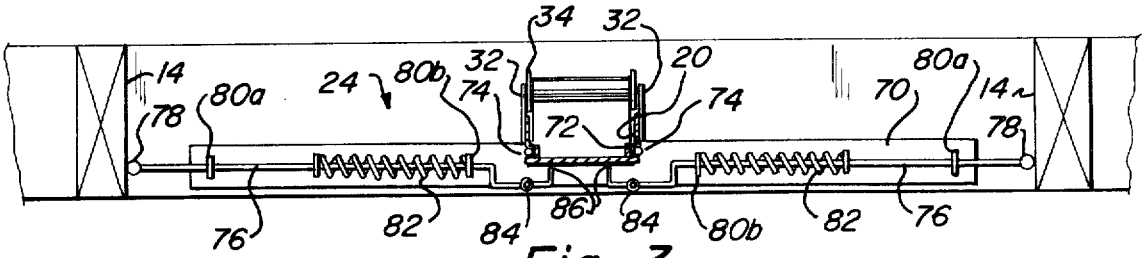
FIG. 3 is an enlarged horizontal section taken along line 33 of FIG. 2.
Figure 5:
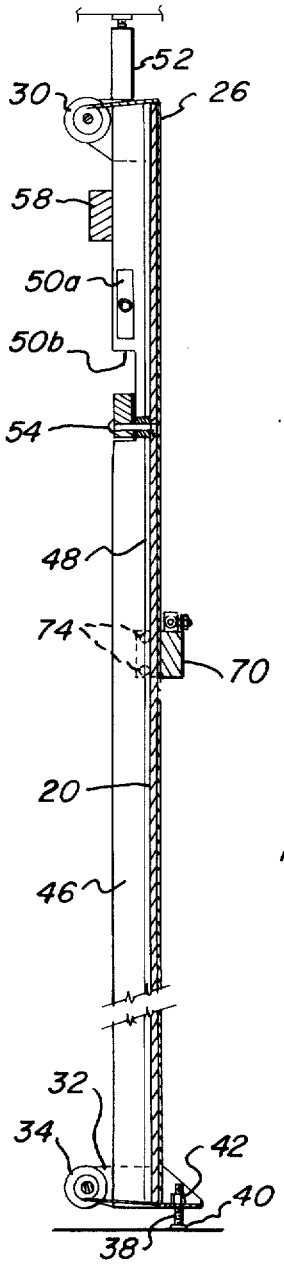
FIG. 5 is an enlarged vertical section with parts removed taken along line 55 of FIG. 2.

The positioning arms 52 are biased outwardly by the biasing member 56, FIG. 4, which includes a tubular housing 88 from which a pair of oppositely directed pins 90 protrude and are biased outwardly by a common compression spring 92 contained in the housing between the inner ends of the pins. Each pin has a sperical head 94 on its distal end which is received in a spherical socket in the associated arm 52 so that it is retained in connected relationship with the positioning arm. The spherical connection allows pivotal movement between the biasing member 56 and the positioning arms 52 so that while the biasing member biases the positioning arms outwardly engaging their distal ends with the side door jambs, they are free to pivot relative to the biasing member. The rubber abuttment pad 62 on the distal end of each arm 52 frictionally engages the associated side door jamb 14 and the spring bias applied thereto by the biasing member is sufficient to suspend the entire apparatus within the doorway.

Since it is important that the plumb guide beam 20 be vertically oriented during the use of the apparatus so that the markable material 26 extends vertically, the apparatus has been designed so that it is self-plumbing. In other words, the positioning arms 52 are pivotally connected to the guide beam at a location 54 above its longitudinal center, which is the approximate center of gravity of the guide beam and once the positioning arms have been biased against the side door jambs to suspend the guide beam within the doorway, the guide beam will seek a vertical plumb position. After attaining a vertical position, the adjustment screw 38 at the bottom of the guide beam is advanced against the threshold 18 to secure the guide beam in the vertical position.

The markable material 26 which is extended along the front face 44 of the guide beam 20 could be any suitable material upon which the desired information can be recorded in some manner, but in the preferred forms, so that the material is useful with the cutting apparatus to be described hereinafter for cutting the doors, the material 26 is a transparent tape which is secured at opposite ends to the spools 30 and 34 at the top and bottom of the guide beam respectively. Preferably, the tape is of sufficient length so that information relating to a plurality of doorways can be recorded thereon by advancing the tape from one spool to the other always presenting a clean blank surface for each door opening to be measured.

In operation of the apparatus 10, it is first placed in the doorway so that the positioning arms 52 engage the side door jambs 14 adjacent the tops thereof and so that the plumb guide beam 20 is suspended in the doorway. In order to center the plumb guide beam in the doorway, the positioning arms are pivoted relative to each other until the horizontal level member 58 indicates that it is horizontal. With the horizontal orientation of the level member, the inner pivotally connected ends of the positioning arms are equally spaced from the side door jambs 14, and the guide beam is centered in the doorway freely pivotal about the pivot connection to the positioning arms. In this orientation, the guide beam will seek a vertical plumb position as discussed before. After it has attained the vertical position, it is secured in this position by advancing the adjustment screw 38 against the threshold. The adjustment screws 60 at the terminal ends of the positioning arms 52 can then be advanced upwardly until they engage the head door jamb 16 and the relative spacing of the terminal ends of the positioning arms as indicated by the calibrated adjustment screws 60 can be recorded on the transparent markable material 26 for later use in cutting the door. With the apparatus so oriented within the doorway, the tracing beam 70 is mounted upon the guide beam so that the marking heads 86 engage the transparent marking material and the tracing beam is advanced vertically along the full length of the guide beam. The followers 78 at the outer ends of the tracing arms 76 will follow the contour of the associated side door jambs and this contour will be marked on the transparent material with the marker heads so that a pair of lines corresponding to the contour of the side door jambs are recorded on the transparent material for use in cutting the side edges of the door. By placing the horizontal tracing beam at its lowermost position on the guide beam, the distance between each end of the tracing beam and the threshold 18 of the doorway can be measured to give the angular variation of the threshold from horizontal. This information can be recorded on the transparent paper so that the lower edge of the door can be cut accordingly to match the threshold. It will be readily appreciated that the appratus is useful in quickly sizing, measuring and recording information relating to the side and head door jambs as well as the threshold of a doorway. Since the marking material is long enough to accommodate a number of door measurements, the apparatus can be used over and over, each time recording information on a blank portion of the marking material so that the information relating to a plurality of doorways is recorded on the same roll of material.

Figure 6:
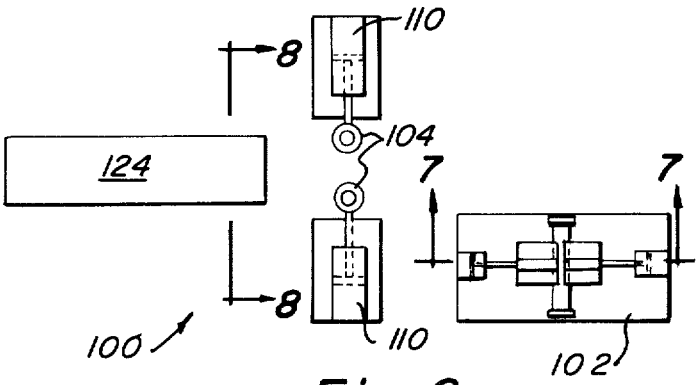
FIG. 6 is a diagramatic plan view of a cutting apparatus used in the method of the present invention.
Figure 7:
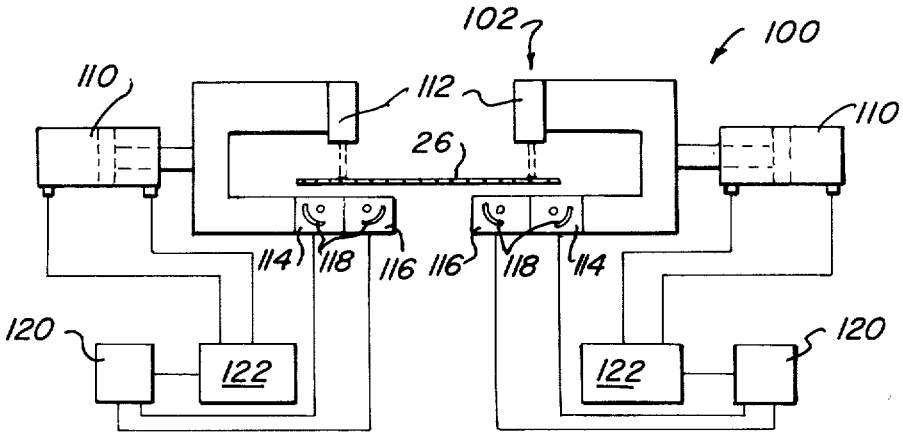
FIG. 7 is an enlarged vertical section taken along line 77 of FIG. 6.
Figure 8:
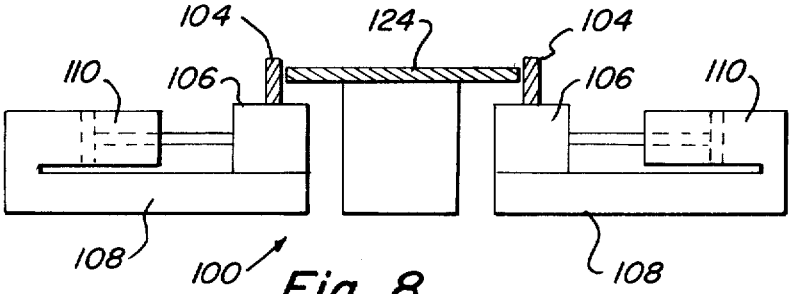
FIG. 8 is an enlarged vertical section taken along line 88 of FIG. 6.

The information recorded on the tape 26 in accordance with the method of the present invention is used to operate a cutting apparatus 100, FIGS. 6 through 8, which is adapted to cut the side edges of the door in matching relationship with the lines marked on the tape. Referring particularly to FIG. 6, the cutting apparatus 100 can be seen to include a reader mechanism 102 and a pair of laterally spaced cutting blades 104 which in the preferred form are in the form of high speed straight bits each driven by an electric motor 106 similar to a large router or shaper motor. These units are mounted on cutter beds 108 so that their angle of cut is adjustable and also their depth of cut is regulated by sliding the unit toward and away from the opposite unit. Each cutter unit is fixed firmly to a hydraulic ram 110 so that it can be advanced toward or away from the opposite unit in response to operation of the hydraulic ram.

The hydraulic ram 100 for each cutter unit is controlled by the reader mechanism 102 which is adapted to sense the lines marked on the tape corresponding to each side door jamb of the doorway. Referring to FIG. 7, the reader mechanism has a pair of light sources 112 which project beams of light smaller than the width of the lines marked upon the material. Directly below each light source, are two photo electric cell compartments 114 and 116 with a slot (not shown) the size of the light beam centered over the compartments in such a way that if the tape is not present, half of the light goes into each compartment and strikes each photo cell plate 118 with equal intensity. If the tape is loaded into the reading mechanism and the opaque line on the material is over the slot, then no light will pass into either compartment. The photo cells each activate an amplifier circuit 120, which in turn activates a hydraulic valve 122 which releases the hydraulic pressure to the hydraulic ram 110 of one of the cutter mechanisms to drive the hydraulic ram toward or away from the opposite hydraulic ram. One photo cell 118 causes the associated hydraulic ram to move one direction and the other photo cell 118 causes the ram to move in the opposite direction.

To operate the reader mechanism, the tape is first loaded in the mechanism and the light sources 112 turned on. The photo cells 118 are then neutralized and by manual operation of the hydraulic valve 112 the ram 110 moves with the light source until the light beam is centered on the marking associated therewith so that no light is hitting either photo cell therebeneath. This operation is carried out for the line markings relating to the left and right side door jambs. The photo cells are then activated. A drive mechanism (not shown) is then energized to advance the tape 26 through the reader mechanism 102 at the same rate at which a blank door member 124 is advanced between the cutter blades 104. So long as the line markings on the tape continues to run in a straight line no light will be received by the photo cell 118 and the cutter blades will remain in a fixed position. However, if the line marking moves to the right it will begin to expose a portion of the slot and light will strike the photo cell plate on the left. This will then activate the hydraulic valve and in turn the associated hydraulic ram will move in the direction necessary to cause the light beam to also move to the right. Presently, the light beam will catch up with the marking and the light will no longer hit the photo cell plate and the ram will maintain a fixed position again. With the system balanced and adjusted properly, it will follow the side door jamb contour as represented by the line marking causing the side edges of the door to be cut to correspond with the line markings and thus with the side door jambs of the door opening.

After the side edges have been cut in accordance with the aforedescribed method, the top and bottom edges of the door are cut to correspond with the head door jamb and threshold of the doorway respectfully as per the instructions written on the tape designating the relationship of the head door jamb and the threshold with horizontal. After the top and bottom edges of the door have been cut, the door will be precisely cut to match the doorway in which it is to be mounted.

It will be appreciated that by using the apparatus and method of the present invention, a number of doorways can be measured and sized at a particular location and the information forwarded to a cutting plant where the necessary cutting equipment is installed and ready for use. The doors can then be cut and fowarded to the installation site where they will precisely match the doorways for which they were cut. By properly coding the tape with each doorway being measured, the doors can be labeled and quickly installed once they have been delivered to the installation site. This alleviates the necessity of having a cutting instrument at each installation site and also alleviates the imprecise method previously employed for sizing and cutting doors for selected doorways.

Although the present invention has been described with a certain degree of particularity, it is understood that the present disclosure has been made by way of example and that changes in details of structure or procedure may be made without departing from the spirit thereof.

What is claimed is:

1. Apparatus for sizing a door to fit a selected doorway having a frame with side door jambs and a head door jamb comprising in combination:

a single support member adapted to extend vertically approximately along the center line of a doorway, information receiving material on said support member extending substantially the entire height of the doorway, tracing means including a pair of follower arms operably connected to said support member for vertical movement therealong substantially the entire height of said doorway, said follower arms being biased away laterally in opposite directions from the support member so as to operatively engage the side door jambs, recording means on said tracing means operably connected to each follower arm for conjoint vertical movement therewith, such that vertical movement of said follower arms will trace the contour of said doorway end conjoint movement of said recording means will continuously record said contour on said information receiving material so that said recorded information can be used to cut the sides of a door to fit the doorway opening.

2. The apparatus of claim 1 further including centering means operably connected to the support means and being adapted to center the support means on the center line of the doorway between the side door jambs.

3. The apparatus of claim 2 wherein said centering means includes a pair of equal length positioning arms pivotally connected to the support means so as to be movable into engagement with the side door jambs.

4. The apparatus of claim 3 wherein said centering means further includes leveling means slidably connected to each of said arms such that when the leveling means is horizontally disposed and the positioning arms are engaged with the side door jambs, the connection location of the positioning arms to the support means is centered between said side door jambs.

5. The apparatus of claim 4 wherein said positioning arms include friction means for engaging the side door jambs and wherein said centering means further include holding means for retaining said positioning arms in frictional engagement with the side door jambs such that the positioning arms can pivotally suspend the support means to allow the support means to be vertically suspended.

6. The apparatus of claim 5 wherein the center of gravity of the support means is below its pivotal connection to the positioning arms so that the support means will automatically seek a vertical orientation when suspended by the positioning arms.

7. The appartus of claim 5 wherein said holding means comprises spring biasing means operably interconnecting said positioning arms to bias the arms in opposite directions and into engagement with the side door jambs.

8. The apparatus of claim 5 further including calibrated adjustable means at the ends of said positioning arms adapted to be advanced upwardly into engagement with the associated end of the head jamb to thereby indicate any difference in elevation of the opposite ends of the head jamb.

9. The apparatus of claim 1 wherein said tracing means includes resilient means for biasing said follower arms into engagement with the side door jambs.

10. The apparatus of claim 9 wherein said tracing means is removably mounted on said support means.

11. The apparatus of claim 1 wherein said information receivable material consists of a strip of sheet material supported at opposite ends on rotatable spools, said spools being mounted upon said support member so that the paper strip can be advanced along said support member from spool to spool.

* * * * *